US006496169B1

(12) United States Patent
Mametsuka

(10) Patent No.: US 6,496,169 B1
(45) Date of Patent: Dec. 17, 2002

(54) LIQUID CRYSTAL DISPLAY DEVICE

(75) Inventor: Koji Mametsuka, Ageo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/273,764

(22) Filed: Mar. 22, 1999

(30) Foreign Application Priority Data

Mar. 23, 1998 (JP) ..... 10-073876

(51) Int. Cl.[7] ..... G09G 3/36

(52) U.S. Cl. ..... 345/87; 345/98; 345/99; 345/100

(58) Field of Search ..... 345/98, 87, 100, 345/94, 96, 208, 209, 210, 213, 99, 204

(56) References Cited

U.S. PATENT DOCUMENTS

| | | | | |
|---|---|---|---|---|
| 4,651,148 A | * | 3/1987 | Takeda et al. | 340/805 |
| 4,724,433 A | * | 2/1988 | Inouie et al. | 340/805 |
| 4,746,915 A | * | 5/1988 | Sekiya | 340/719 |
| 5,093,655 A | * | 3/1992 | Tanioka et al. | 340/784 |
| 5,648,685 A | * | 7/1997 | Misawa et al. | 257/775 |
| 5,748,165 A | * | 5/1998 | Kubota et al. | 345/96 |
| 5,818,412 A | * | 10/1998 | Maekawa et al. | 345/100 |
| 5,977,944 A | * | 11/1999 | Kubota et al. | 345/100 |
| 6,078,368 A | * | 6/2000 | Ichikawa et al. | 349/48 |
| 6,107,983 A | * | 8/2000 | Masuda et al. | 345/98 |
| 6,191,768 B1 | * | 2/2001 | Imamura et al. | 345/98 |
| 6,195,758 B1 | * | 2/2001 | Lundh et al. | 713/500 |
| 6,252,572 B1 | * | 6/2001 | Kurumisawa et al. | 345/98 |

FOREIGN PATENT DOCUMENTS

| | | |
|---|---|---|
| JP | 5-216441 | 8/1993 |
| JP | 5-241536 | 9/1993 |
| JP | 7-20826 | 1/1995 |
| JP | 9-212133 | 8/1997 |

OTHER PUBLICATIONS 5.5: A High–Resolution 0.7–in–Diagonal TFT–LCD, T.Maekawa et al SID 92 DIGEST pp. 55–58.

* cited by examiner

*Primary Examiner*—Vijay Shankar
(74) *Attorney, Agent, or Firm*—Pillsbury Winthrop LLP

(57) ABSTRACT

The present invention is a liquid crystal display device in which liquid crystal pixels are arranged in an active matrix, and the device includes a timing control circuit for driving an active matrix type liquid crystal display device, in which the superimposing time between adjacent shift resistor output signals from the shift resistors connected in series, is detected by the logic circuit, and in the case where the superimposition of signals occurs as the output of a signal of the subsequent shift resist is started during a signal is being outputted from one previous shift resistor, a timing signal for forcibly turning off the output of the previous shift resistor on the basis of a detected signal by the logic circuit when the subsequent shift resistor is turned on, such as to control the switching operation of the switch for driving the liquid crystal device.

31 Claims, 9 Drawing Sheets

LIQUID CRYSTAL DISPLAY DEVICE

BACKGROUND OF THE INVENTION

The present invention relates to a liquid crystal display device having the structure in which a liquid crystal display device of an active matrix type and a timing control circuit are formed of thin film transistors having the structures identical to each other, which are formed on the same substrate.

In general, liquid crystal display apparatus have the characteristics of light weight, thin in measurements, a low-consumption power, and the like, as compared to other display devices such as cathode ray tube and the like. For this reason, the liquid crystal display apparatus are widely used as the display device for a television set, a mobile data terminal, a graphic display or the like.

An example of the liquid crystal display apparatus is an active matrix type liquid crystal display apparatus having a structure in which thin film transistors (to be called TFT(s) hereinafter) which operate as switching elements are arranged. The active matrix-type liquid crystal display apparatus has a high-speed responsibility, and is capable of increasing the clearness and fineness of a displayed image, and therefore the display apparatus of this type is becoming more popular as an element for achieving the current demands, that is, a higher quality of the display screen, an increase in the size of the screen, and a color image.

Further, recently, there are demands of narrowing the frame of the screen decreasing the thickness of the apparatus, and increasing the clearness and fineness of a screen. In order to meet such demands, a drive-circuit-monolithic type liquid crystal display apparatus equipped with a built-in drive circuit has been proposed.

The drive-circuit-monolithic type liquid crystal display apparatus has a characteristic structure in which a signal line drive circuit and a scan line drive circuit are arranged on the same substrate.

FIG. 5 is a diagram showing an example of the conventional circuit structure of a signal line drive circuit, and FIG. 6 is a diagram showing an example of the drive waveforms of the circuit.

This signal line drive circuit consists of a plurality of shift registers 1*a,* 1*b,* . . . , 1*n*, a plurality of buffer circuits 2*a,* 2*b,* . . . 2*n,* a plurality of analog switch groups 3*a,* 2*b,* . . . 3*n,* and a plurality of video bus lines 4*a,* 4*b,* . . . 4*n.*

With the above structure, input video signal on a video bus line 4 is transferred to a signal line 6 in a display region 5 via an analog switch 3.

The switching operation of the switches is controlled by a shift register circuit 1.

A number of the neighboring switches 3 are connected with a single shift register to be switched at the same time. As a result, the signal lines 6 connected to the neighboring switches 3 are charged at the same time. Such neighboring switches and signal lines are called a "circuit block" hereafter.

To the shift register circuit 1, a start pulse XST, and two kinds of clock signals XCK and/XCK having different phases from each other are input. A timing chart at these signals is shown in FIG. 6. The start pulse XST is latched by the shift register and output therefrom as shift data, in synchronism with the clock signals.

In the above-described drive-circuit-integrated type liquid crystal display apparatus, drive-circuits are composed of TFTs witch are formed on a glass substrate, and therefore the characteristics is unstable as compared to a single-crystalline silicon semiconductor circuit.

Due to the unstable characteristics, the time delay or the distortion of the control signals would occur. As a result, the control signals of adjacent analog switches are overlapped each other and so called "ghost" phenomena is observed.

Next, above a ghost phenomena will now be described in more detail.

FIG. 7 shows a normal operation of analog switches. In this case, adjacent pulses have no overlapping portion with each other.

FIG. 8 shows the case that adjacent pulses partially overlap with each other. The waveform b shows an input video signal voltage applied on a video bus line at predetermined period, a waveform c shows an input voltage for the next block applied at one previous horizontal period, and a waveform d shows actual voltage of the video bus line at the predetermined period.

If the adjacent pulses are partially overlapped, a voltage charged in a signal line c of the next block leaks into a video bus line of the block to which a signal is currently input, via an analog switch, as the analog switch is opened.

As a result, the video signal on the bus line is affected by the voltage stored in the signal line capacitance of the next block, to have a voltage waveform 92, and a voltage with the above-described waveform is charged to the signal line; therefore the ghost of one previous horizontal period appears on the screen.

Technical measures for preventing the occurrence of a ghost, are discussed in, for example, Jpn. Pat. Appln. KOKAI Publication No. 5-216441, which proposes a horizontal scanning circuit which can cut a top end portion of a shift pulse until the fall timing of a one previous shift pulse, so as to avoid a superimposing section.

FIG. 9 shows a schematic structure of the technique of the KOKAI publication, and FIG. 10 shows signal waveforms obtained with the technique shown in FIG. 9.

The structure shown here has an arrangement in which a two-terminal input type NOR circuit serving as a fixed pattering removing circuit is added to an output signal terminal side of each of shift registers S/R.

In the circuit structure, a shift pulse (shift register output signal) Dn+1 output from the shift register is inverted by NANDn+1 into a primary pulse signal Bn+1.

The primary pulse signal Bn+1 is input to one of the input terminals of NORn+1 situated on the line, and a pulse signal Φn for driving a switching transistor S, which is output from a delay circuit DLYn of a previous stage is split and input to the other input terminal.

Then, a secondary pulse signal Cn+1 which is a negative logic sum (negative OR) of the primary pulse signal Bn+1 and the pulse signal Φn is output from NORn+1. The secondary pulse signal Cn+1 is delayed by a predetermined time t by the delay circuit DYLn+1, and thus a pulse signal Φn+1 is output.

In other words, the portion A of the primary pulse signal Bn+1, which is the superimposing section of the shift register output signal, is cut out up to the fall of the secondary pulse signal of one previous stage, and further delayed by a predetermined time t by the delay circuit DLY.

Therefore, as can be seen in FIG. 10, the superimposing section A between a pulse signal (analog switch control signal) Φn for driving a switching transistor Sn and a switch transistor Sn+1, and a pulse signal Φn+1, is removed, and further delayed by a predetermined time t. In this manner, ideally, the occurrence of a ghost should be suppressed.

In reality, however, a shift pulse Dn serving as a shift register output signal, that is, analog switch control signal takes a form shown in FIG. 11 as compared to an input start pulse XST.

The shift pulse Dn (solid line) is output in the waveform obtained by differentiating a start pulse XST having a square waveform by means of the internal delay of a flip-flop circuit included in the register shown in FIG. 9.

The rise characteristics of a shift pulse Dn is dependent mainly on the voltage-current characteristics of p-ch TFT which constitutes a clocked inverter within the flip-flop circuit, whereas the breaking characteristics thereof is dependent the voltage-current characteristics of n-ch TFT.

In general, the carrier mobility in a n-ch TFT is higher than that in a p-ch TFT, and therefore the absolute amount of the unevenness of the characteristics is larger in the case of an n-ch TFT. Further, in the case where a so-called LDD (lightly doped drain) structure is employed in an n-ch TFT, the manufacturing process therefor becomes more complex than the case of a p-ch TFT. Therefore, due to the influence of the unevenness in the concentration of the impurities implanted, which is caused due to the nature of the process as described above, the stability of the characteristics is spoiled.

As a result, the unevenness of the transient characteristics of the shift pulse Dn becomes larger in the case of a breaking than in the case of a rise.

As described above, in the conventional technique in which the sampling timing of an analog switch is determined by the breaking of a pulse signal Φn, due to the unevenness of the characteristics of the flip-flop circuits the sampling operation of an analog switch and a video signal could not be synchronized, a ghost cannot be suppressed within an allowable range.

BRIEF SUMMARY OF THE INVENTION

The object of the present invention is to provide a liquid crystal display device in which liquid crystal pixels and a timing control circuit for driving the liquid crystal pixels, which is capable of preventing the occurrence of a ghost, or the deterioration of the display quality level, and even improving the display quality, are formed on the same substrate.

In order to achieve the above-described object, there is provided, according to the present invention, a liquid crystal display device including: liquid crystal pixels provided at intersections of scanning lines and signal lines arranged in matrix on an insulation substrate, and connected to the signal lines via transistors; switching sections, formed on the insulation substrate, for supplying video signals to the signal lines selectively by switching; a shift register consisting of a plurality of flip-flop circuits which are connected in cascade, and each serve to transfer a shift pulse to a subsequent one in order in synchronism with a predetermined clock signal, and output them in parallel; a pulse-overlap detecting circuit for receiving output pulses from flip-flop circuits adjacent to each other, and generating and outputting an inverted logical product signal of these output signals; and an output circuit, to which an output pulse outputted from one previous flip-flop circuit of the adjacent flip-flop circuits, and the inverted logical product signal are input, for generating and outputting a logical product signal of the output pulse and the inverted logical product signal.

In the liquid crystal display device having a timing control circuit having the above-described structure, the superimposition of output signals of shift registers located adjacent to each other, is detected by a logic circuit, and based on the detected signal, the previous analog switch is forcibly switched on or off to output a control signal. In other words, the operation timing of an analog switch connected to the shift register of one previous stage is determined by the rise timing of the output from the shift register of the next stage. With this operation, the delay of the operation timing does not become uneven so much among the analog switches, and therefore a high-quality display can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described in detail with reference to accompanying drawings.

Figure 1:
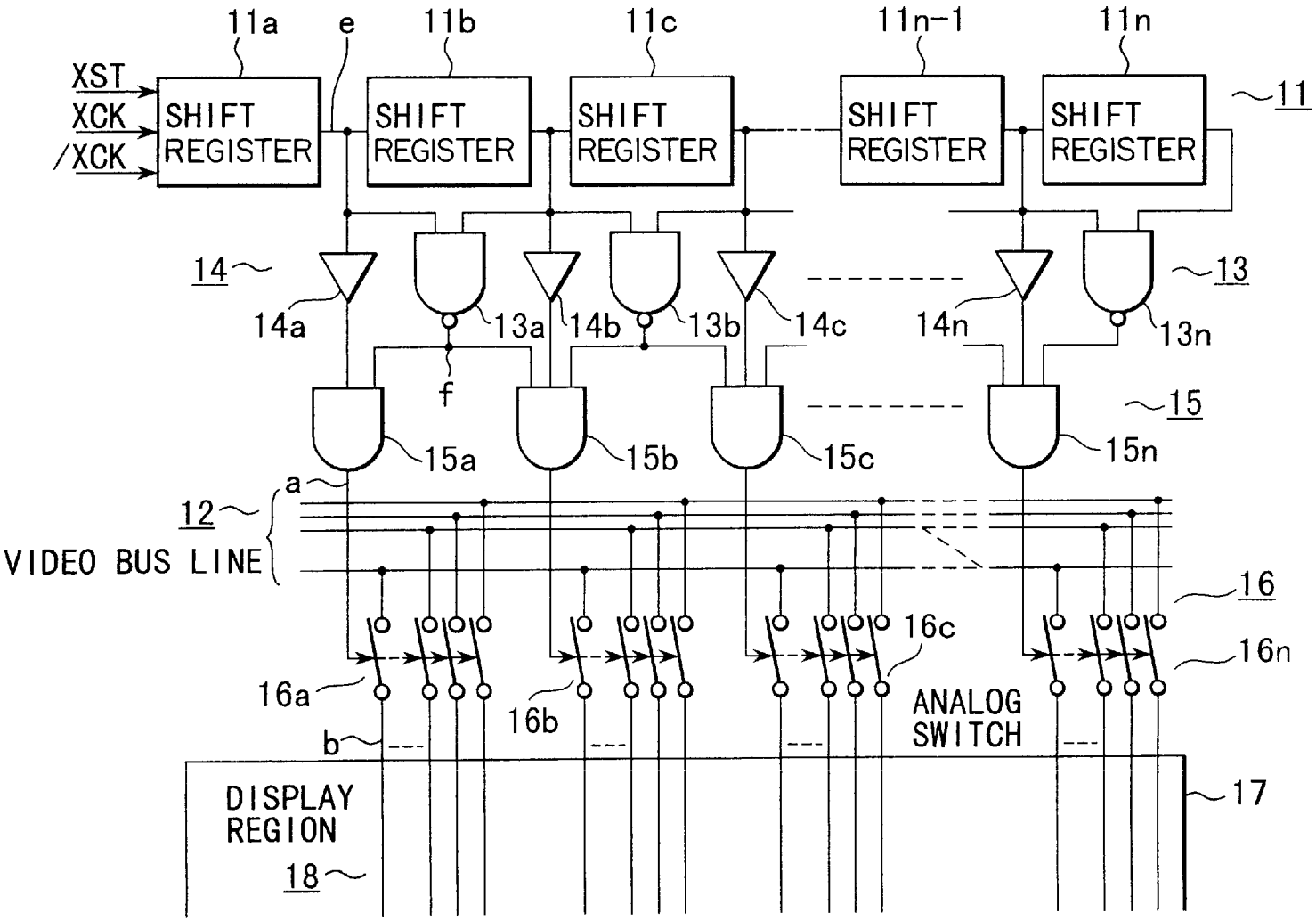
FIG. 1 is a diagram schematically showing the structure of a liquid crystal display device containing a timing control circuit built therein, according to the first embodiment of the present invention.

FIG. 1 shows an example of the structure of a signal line drive circuit containing a timing control circuit built therein, for driving a liquid crystal display device, according to the first embodiment of the present invention, which will now be described.

Shift resistors, pulse-detect circuits and output circuits, which constitute the timing control circuit, are made of thin film transistors.

The thin film transistors which constitutes the timing control circuit are, for example, polycrystalline silicon thin film transistors.

The circuit structure of this embodiment consists of a plurality of shift registers 11 (11*a,* 11*b,* . . . 11*n*) connected to each other in series (cascade connection), a plurality of video bus lines 12 (12*a,* 12*b,* . . . 12*n*), NAND circuits 13 (13*a,* 13*b,* . . . 13*n*) each for inputting two shift register output signals of shift registers 11 adjacent to each other (for example, shift register 11*a* and shift register 11*b*), buffer circuits 14 (14*a,* 14*b,* . . . 14*n*) for respectively inputting shift register output signals output from the shift registers 11, AND circuits 15 (15*a,* 15*b,* . . . 15*n*) for inputting outputs from adjacent NAND circuits 13 (for examples, circuits 13*a* and 13*b*) and outputs from a buffer circuit 14 (for example, buffer circuit 14*b*), an analog switch group 16 (16*a,* 16*b,* . . . 16*n*) which carries out an open/close operation on the basis of an analog switch control signal (timing control signal) output from the AND circuit 15, a display region 17 in which liquid crystal pixels are arranged in matrix, and signal lines 18 for supplying video signals to the liquid crystal pixels (not shown) in the display region 17 through the analog switch group 16.

Signal line drive circuit including a group of analog switches and video bus lines are made of thin film transistors. The thin film transistors are p-ch silicon thin film transistors.

The structure of the display region is similar to that shown in FIG. 3, which will be explained later. A liquid crystal display device is made of a pair of a liquid crystal cell L and a thin film transistor (active element) TFT, and further includes a vertical scanning section; however it is not shown in FIG. 1. It should be noted that for the AND circuit 15*a,* there is no previous NAND circuit output, and therefore there are only two outputs inputted to the circuit 15*a,* one from the NAND circuit 13*a* and the buffer circuit 14*a*.

Each of the AND circuits 15 cuts the top end and tail end of a shift register output signal outputted from the respective buffer circuit 14 on the basis of the output signals from the NAND circuits 13 arranged on both sides of the circuit 15 in this figure, and outputs thus cut signal as an analog switch control signal (timing control signal). The tail end of the shift register output signal is cut out when the top end of the shift register output signal subsequently output rises (when it is ON).

Figure 2:
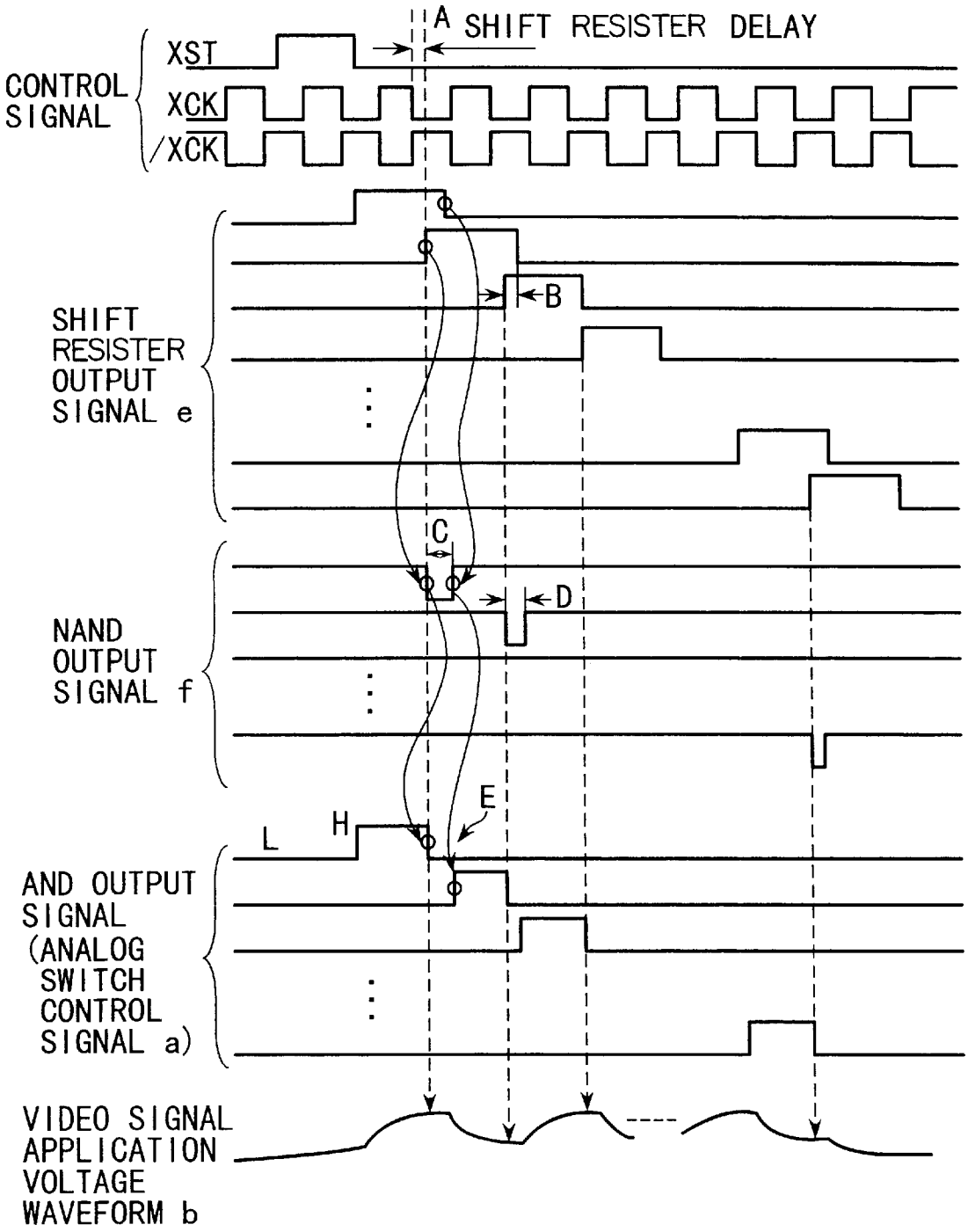
FIG. 2 is a diagram showing waveforms designed to illustrate the operation of the signal line drive circuit shown in FIG. 1.

FIG. 2 shows waveforms for driving the signal line drive circuit shown in FIG. 1, and illustrates the operation thereof. In this figure, the waveforms of control signals XST, XCK and/XCK, a shift register output signal e, a NAND circuit output signal f, an AND circuit output signal, that is, an analog switch control signal a, and a video signal application voltage b are shown.

To the signal line drive circuit, three types of control signals, that is, control signals XST, XCK and/XCK are input. The control signal XST is supposed to shift in order in synchronism with the breaking of the control signal XCK; however the shift register output signal e rises later than the breaking of the control signal XCK (indicated by arrow A) due to the circuit delay and/or the distortion of the control signal, and further falls later than the breaking of the next control signal XCK (indicated by arrow B). Thus, the shift pulse delay occurs.

The delay of the shift pulse occurs due to the internal delay of the shift register, as described in connection with the problem of the conventional technique. Further, due to the unevenness of the characteristics of the TFTs, which is created during the manufacture thereof, or the like, the breaking time of the shift register output signal e become uneven much more widely than the case of the rise time.

Therefore, the pulse width of a NAND circuit output signal f obtained from the inputs from adjacent shift register output signals e, is greatly influenced by the delay amount of the shift pulse (indicated by arrows C and D), as shown in FIG. 2. However, in the case where there is no pulse-overlapping between signals of the adjacent shift registers 11, the NAND circuit output signal f is at a constant high voltage level.

In this embodiment, each of the NAND circuit output signals f has a signal waveform which reflects the delay and the pulse-distortion of the shift register 11 of each stage. Therefore, by utilizing the signal waveforms, H and L levels of an analog switch control signal a are created. That is, in order to execute the switching ON and OFF (arrow E), the AND circuit output signals shown in FIG. 2, that is, the analog switch control signals a, are used to generate an interval between signals, which corresponds to the pulse width. Therefore, even if they are located to be adjacent to each other, they are not superimposed. In other words, the sampling timing for each analog switch is determined by utilizing the rise waveform which has a less uneven in the transient characteristics, and therefore it becomes possible to suppress the unevenness of the delay amount to the clock.

Consequently, according to the present invention, adjacent analog switches 16 are never opened at the same timing, and therefore the leaking of a voltage of the next block which was charged in one previous horizontal period, through an adjacent analog switch 16 can be prevented. Thus, it is possible to charge a desired video signal application voltage appropriately to a signal line, and the occurrence of a ghost in the display region 17 can be prevented.

Figure 3:
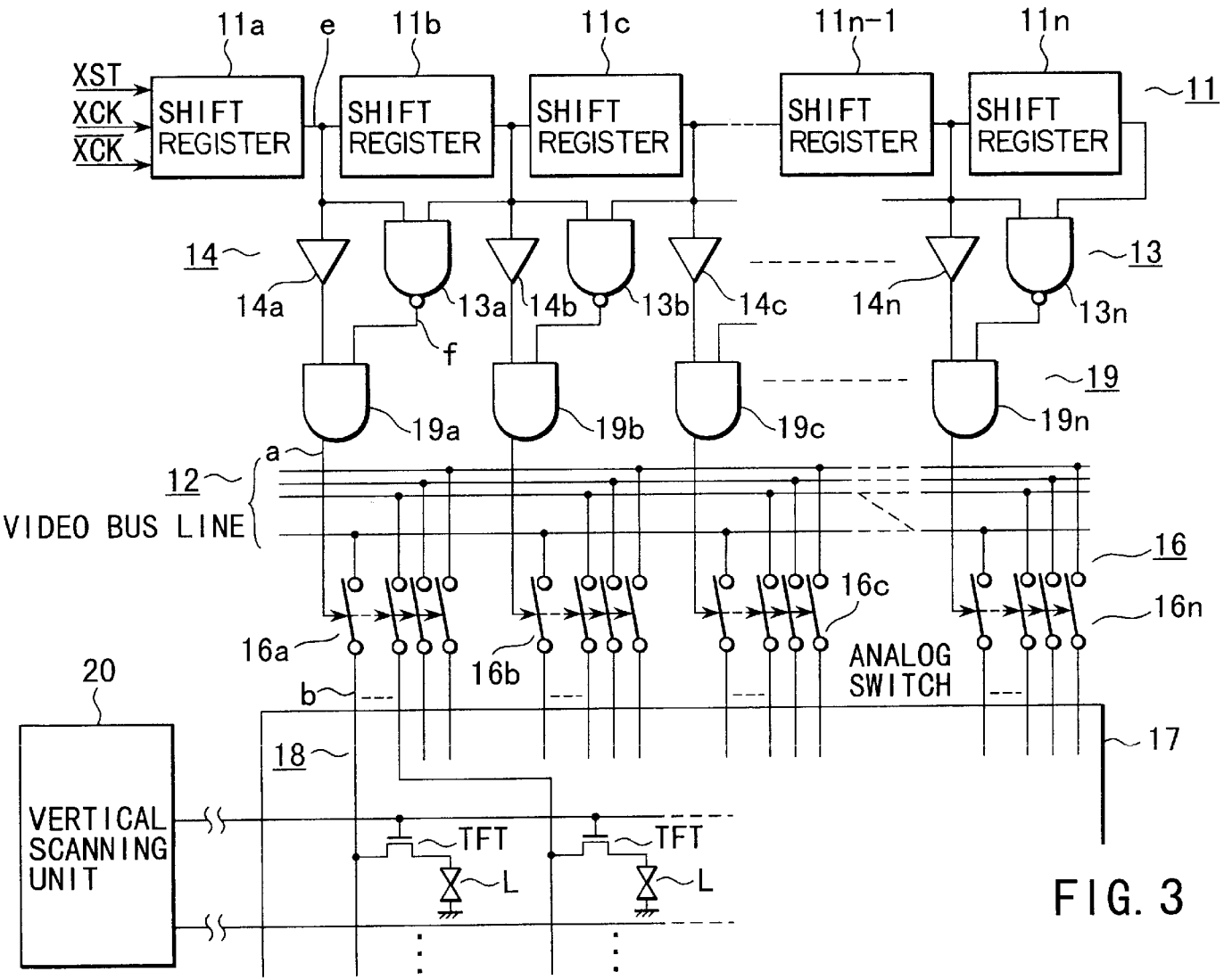
FIG. 3 is a diagram schematically showing the structure of a liquid crystal display device containing a timing control circuit built therein, according to the second embodiment of the present invention.
Figure 4:
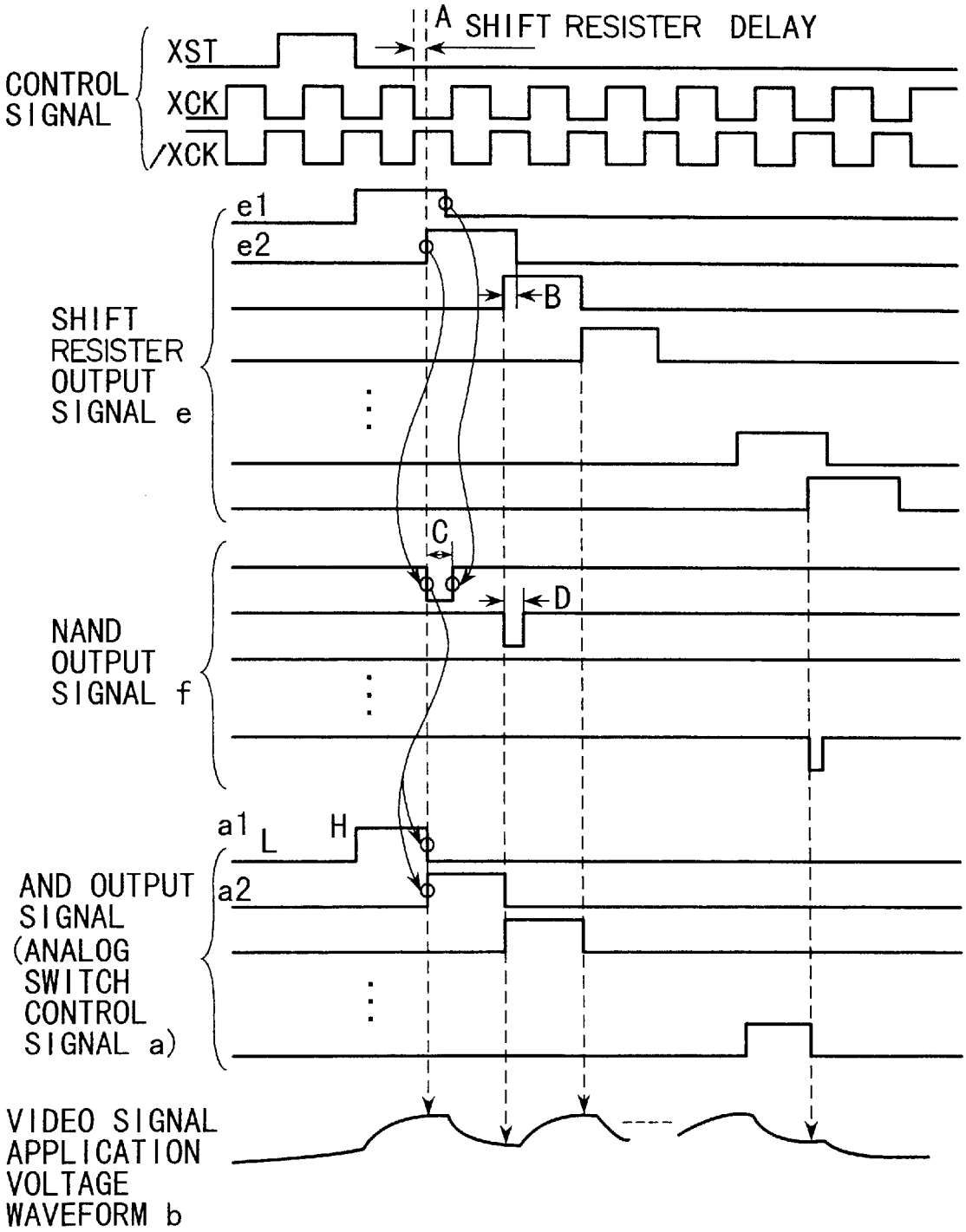
FIG. 4 is a diagram showing waveforms to illustrate the operation of the signal line drive circuit shown in FIG. 3.
Figure 5:
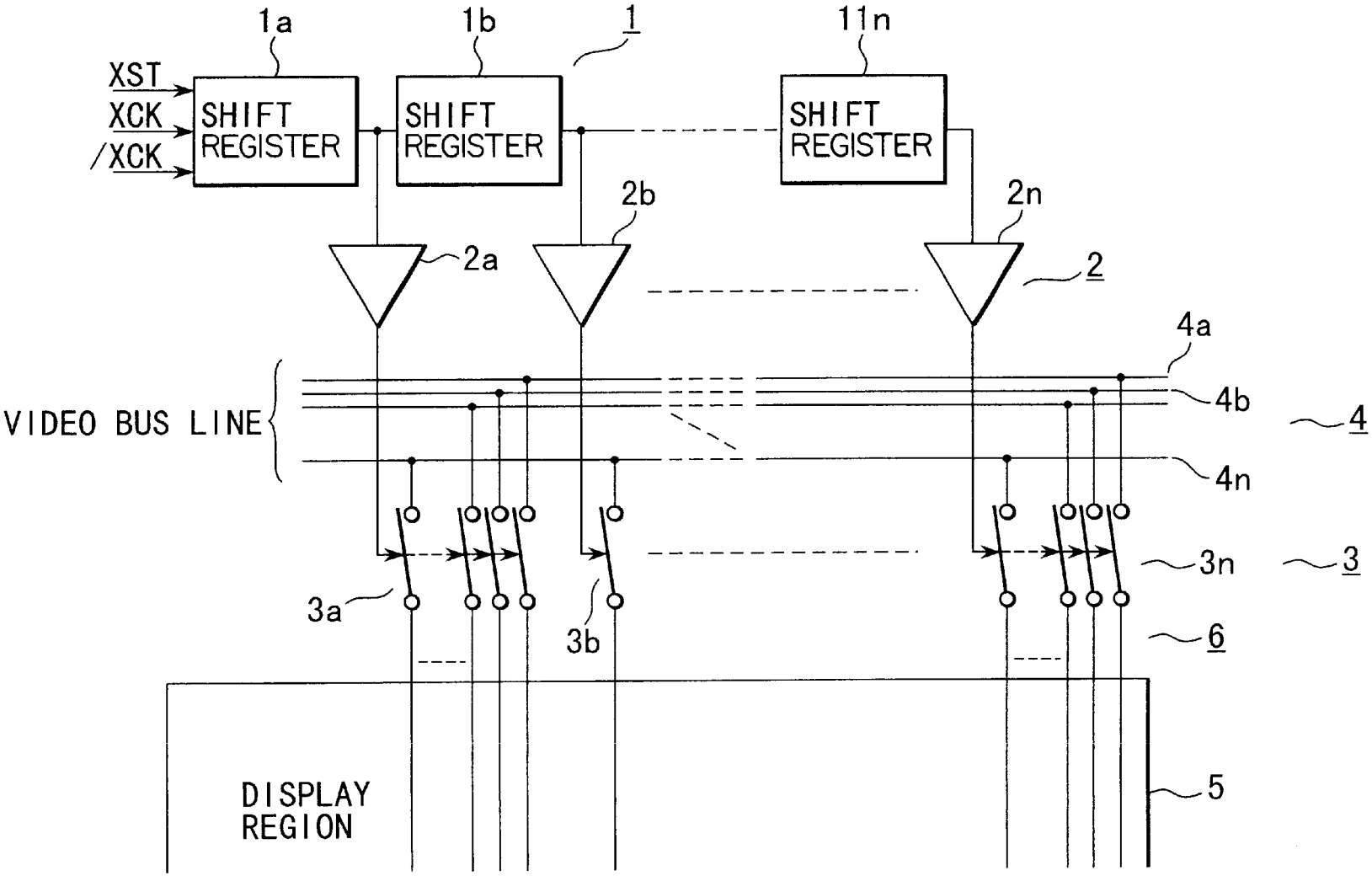
FIG. 5 PRIOR ART
FIG. 5 is a diagram schematically showing the structure of a conventional signal line drive circuit.
Figure 6:
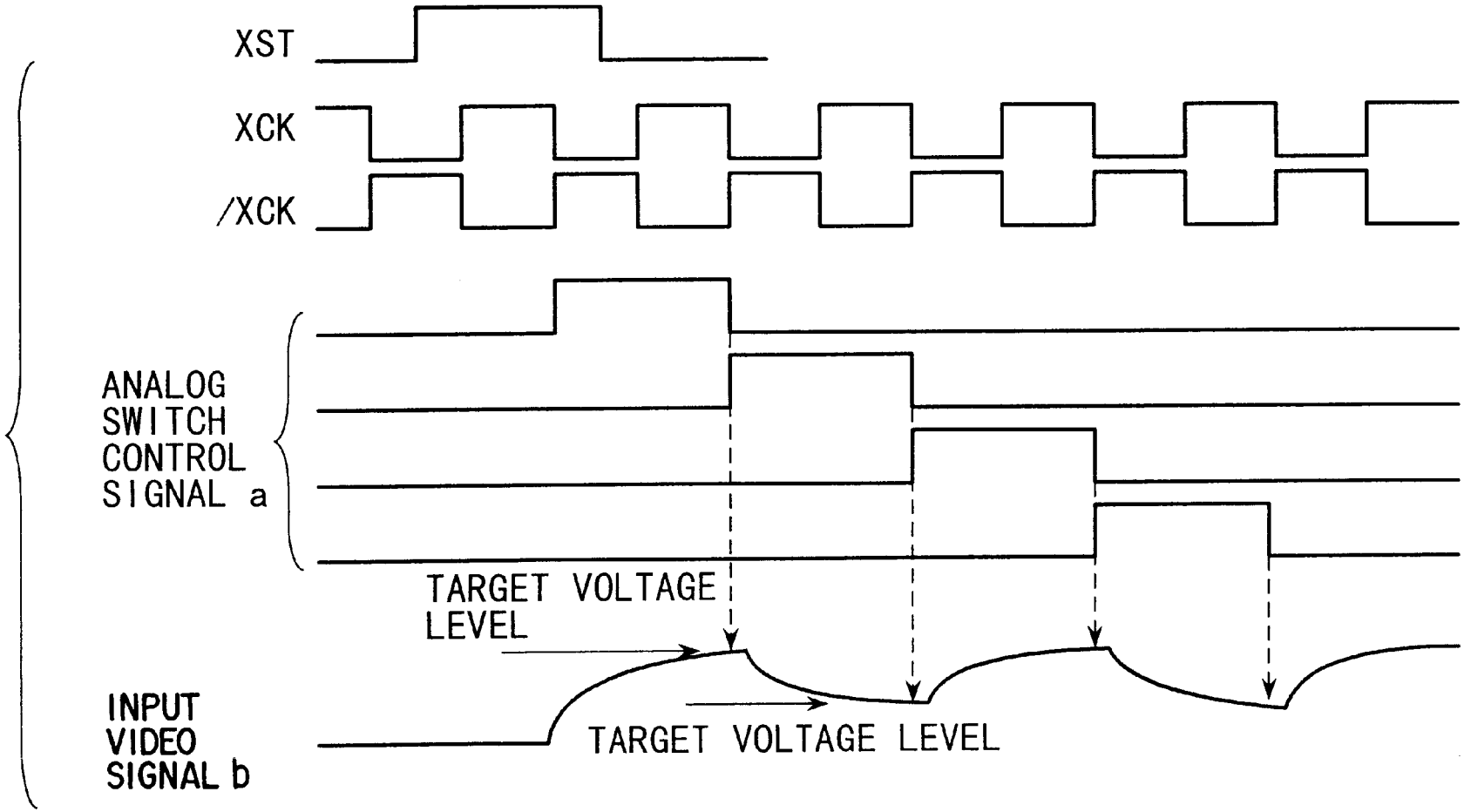
FIG. 6 PRIOR ART
FIG. 6 is a diagram showing waveforms to illustrate the operation of the conventional signal line drive circuit.
Figure 7:
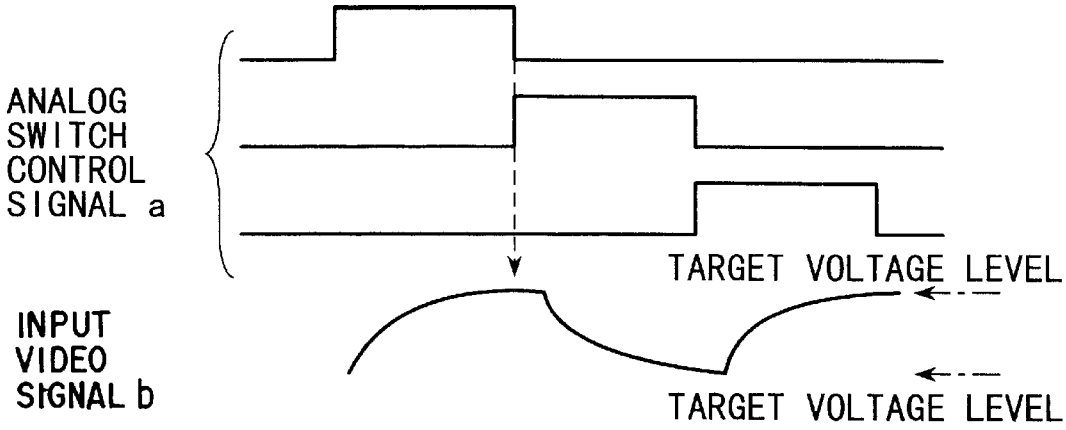
FIG. 7 PRIOR ART
FIG. 7 is a diagram showing waveforms of an analog switch control signal and a video signals of the conventional technique, in the case where there is no superimposition in the analog switch control signals.
Figure 8:
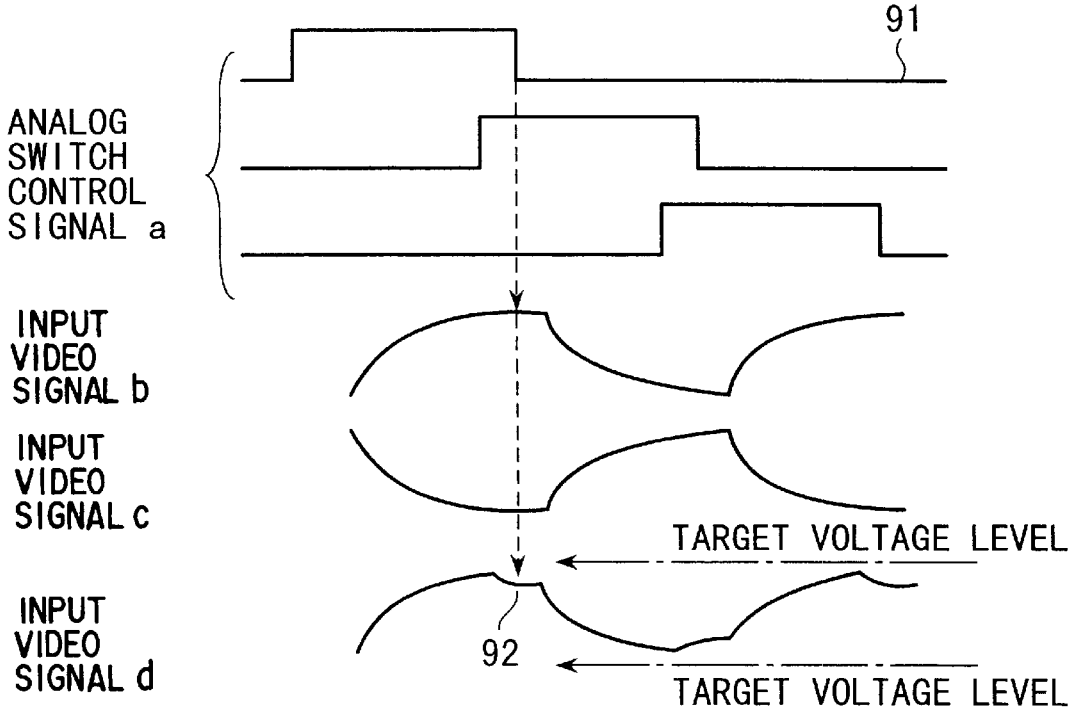
FIG. 8 PRIOR ART
FIG. 8 is a diagram showing waveforms of an analog switch control signal and a video signals of the conventional technique, in the case where there is no superimposition in the analog switch control signals.
Figure 9:
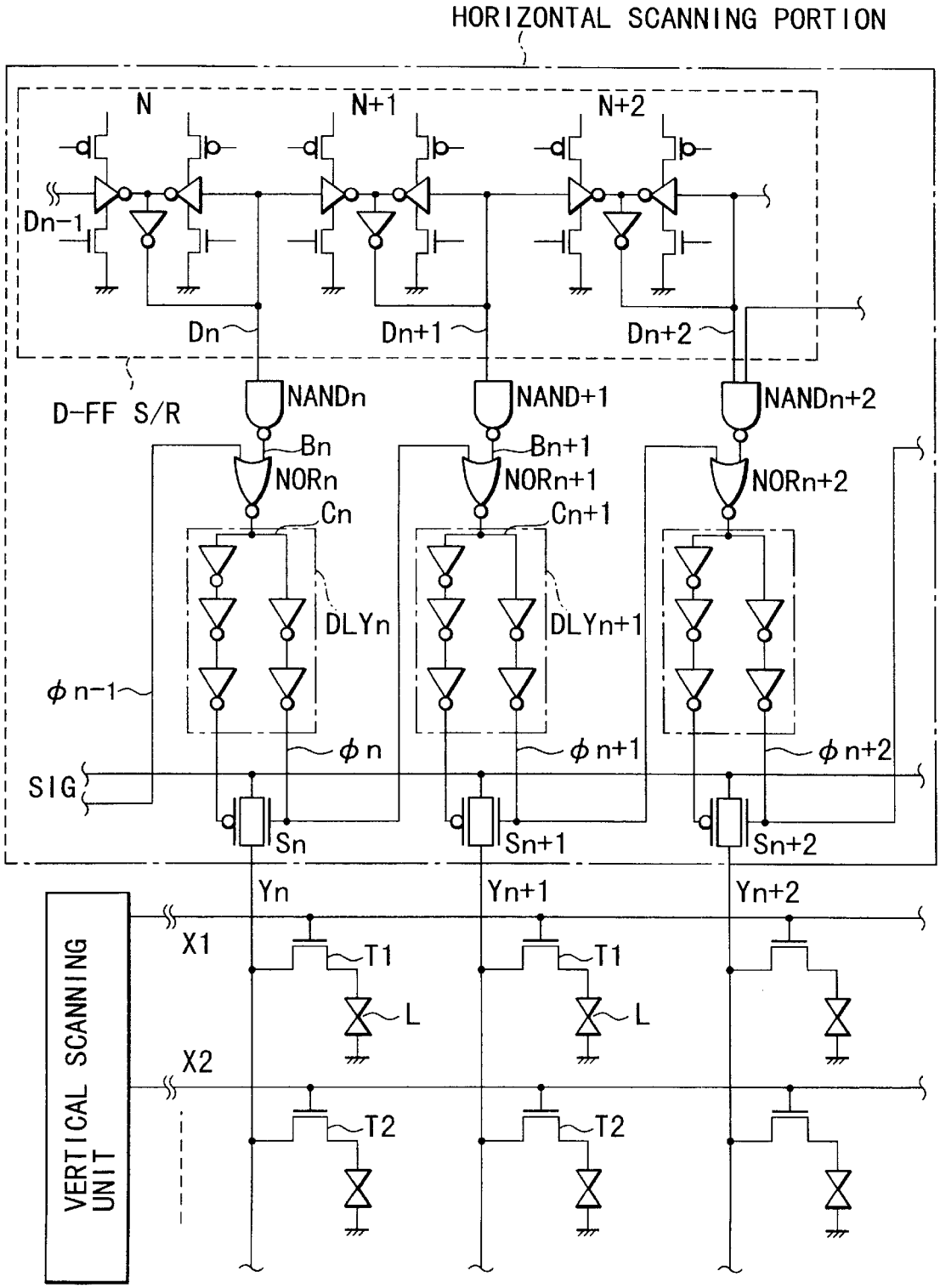
FIG. 9 PRIOR ART
FIG. 9 is a diagram showing an example of the structure of the conventional signal line drive circuit which is designed to prevent the superimposition in analog switch control signals.
Figure 10:
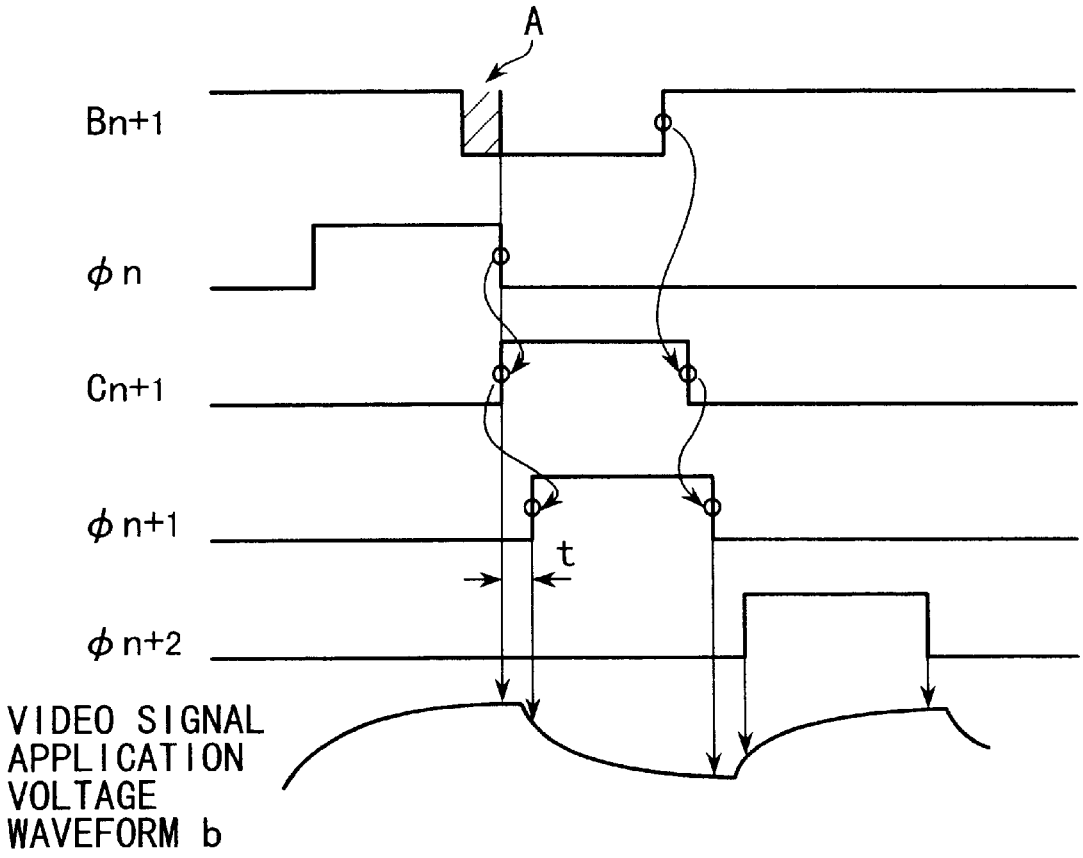
FIG. 10 PRIOR ART
FIG. 10 is a diagram showing waveforms to illustrate the operation of the signal line drive circuit shown in FIG. 8.
Figure 11:
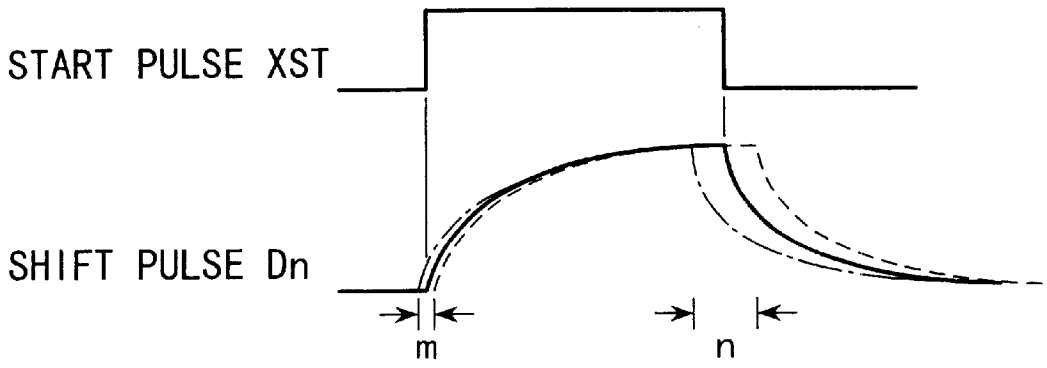
FIG. 11 PRIOR ART
FIG. 11 is a diagram illustrating the dispersion of the transient characteristics of rises and falls of signal application voltage waveforms of shift registers.

FIG. 3 shows an example of the structure of a signal line drive circuit containing a timing control circuit built therein, for driving a liquid crystal display device, according to the second embodiment of the present invention, which will now be described.

In the case of the AND circuits 15 of the first embodiment described above, to the AND circuit 15*b,* for example, three signals, that is, an output from a shift register 11 (output from the buffer circuit 14*b*), and two outputs from the NAND circuits 13*a* and 13*b* adjacent to each other, are input. With this structure, as can be understood from the case of the NAND output signals shown in FIG. 2, the superimposed portion of the shift register output signals e is removed, and therefore one previous analog switch control signal and a subsequent analog switch control signal are separated from each other by a distance which corresponds to the superimposing section.

However, in practical use, as long as one previous analog switch control signal and a subsequent analog switch control signal do not superimpose one on the other, there is not need to have a space between signals.

Based on this fact, according to the second embodiment, as shown in FIG. 3, to each of the NAND circuits 13 (13*a,* 13*b,* . . . 13*n*), shift register output signals e outputted from two shift registers 11 adjacent to each other (for example, registers 11*a* and 11*b*) are inputted, and an output signal f of the NAND circuit 13*a* is input to only an AND circuit 19 (for example, circuit 19*a*) having two input terminals, of one previous stage.

Thus, the AND circuit 19 outputs an analog switch control signal a obtained by the logical product of an output signal from a buffer 11 and an output signal f from the NAND circuit 13, to the analog switch group 16.

A plurality of liquid crystal cells arranged in the display region 17 are arranged in matrix, for example, and liquid crystal pixels has a pair of a liquid crystal cell L and a thin film transistor (active element) TFT, and further includes a vertical scanning section 20.

The thin film transistors which constitutes the signal line drive circuit and the transistors for the display region are formed on the same substrate in the same laminate structure.

See the attached Appendix for the changes made to effect the above paragraphs.

As can be seen from this figure, in the case where there is a superimposing section between shift register output signals e (for example, signals e1 and e2), as the shift register output signal e2 rises, the output signal f of the NAND circuit 13 falls. At that time, the analog control signal a1 (that is, the shift register output signal whose tail end has been cut off) falls.

At the same time as the fall of the analog control signal a1, the analog control signal a2 (shift register output signal e2) rises.

As described above, according to the present invention, even in the case where there is a superimposing section between consecutive shift register signals and the superimposition amount varies from one case to another, one previous analog switch control signal is forcibly made to fall by the rise of the subsequent analog switch control signal, and therefore the superimposing section can be removed.

Further, in the analog switch control signals, the tail end side, which varies widely in the signal fall, is cut, and the switching of signal is carried out on the basis of the rise of signal, which has a less dispersion. Thus, the dispersion in the delay amount of the tail end of an analog switch control signal and a clock signal can be lessen. Therefore, it becomes sufficient only if the phases of the analog switch control signal and the video signal are matched, for the adjustment of the timing of the switching.

In this manner, the liquid crystal display device having a timing control device for driving the liquid crystal device, which can prevent the occurrence of a ghost in the display region and the deterioration of the display quality level, and achieve the improvement of the display quality level, can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device comprising:

liquid crystal pixels provided at intersections of scanning lines and signal lines arranged in matrix on an insulation substrate, and connected to the signal lines via transistors; and a timing control circuit for driving the liquid crystal pixels, wherein said timing control circuit further comprises:

shift registers consisting of a plurality of flip-flop circuits which are connected in cascade, and each serve to transfer a shift pulse to a next stage sequentially in synchronism with a predetermined clock signal, and output pulses from each stage; pulse-overlap detecting circuits for receiving output pulses from flip-flop circuits adjacent to each other, and generating and outputting inverted logical product signals of these output pulses; and output circuits, to which output pulses outputted from one of the previous flip-flop circuits of the adjacent flip-flop circuits, and the inverted logical product signal are input, for generating and outputting logical product signals of the output pulses and the inverted logical product signals.

2. A liquid crystal display device according to claim 1, wherein the pulse-overlap detecting circuits are each made of a NAND gate.

3. A liquid crystal display device according to claim 1, wherein the output circuits are each made of an AND gate.

4. A liquid crystal display device according to claim 1, wherein the shift registers, the pulse-overlap detecting circuits and the output circuits are made of thin film transistors.

5. A liquid crystal display device according to claim 1, wherein the liquid crystal pixels, the shift registers, the pulse-overlap detecting circuits and the output circuits are formed on the same insulating substrate.

6. A liquid crystal display device according to claim 4, wherein the thin film transistors are polycrystalline silicon thin film transistors.

7. A liquid crystal display device according to claim 1, further comprising:

a group of analog switches which open/close depending on the logical product signals outputted consecutively from the output circuits; and video bus lines connected to the analog switches, for transferring video signals to the liquid crystal pixels, wherein the timing control circuit is applied to a signal line drive circuit for driving said plurality of liquid crystal pixels, each made of a pair of a liquid crystal cell and a thin from transistor.

8. A liquid crystal display device according to claim 7, said liquid crystal pixels are driven in units of blocks of a predetermined group, which are defined by said group of analog switches.

9. An array substrate comprising:

transistors provided at intersections of scanning lines and signal lines arranged in matrix on a substrate, and being in contact with the signal lines and the scanning lines;

a signal line drive circuit for applying video signals to the signal lines; and a timing control circuit formed in the signal line drive circuit, wherein the timing control circuits comprise:

shift registers consisting of a plurality of flip-flop circuits which are connected in cascade, and each serve to transfer a shift pulse to a next stage sequentially in synchronism with a predetermined clock signal, and output output pulses from stages of the flip flop circuits.

pulse-overlap detecting circuits for receiving output pulses from flip-flop circuits adjacent to each other, and generating and outputting inverted logical product signals of these output pulses; and output circuits to which output pulses outputted from one previous flip-flop circuit of the adjacent flip-flop circuits, and the inverting logical product signal are input, for generating and outputting logical product signals of the output pulses and the inverted logical product signals.

10. The array substrate according to claim 9 wherein the pulse-overlap detecting circuits each comprise a NAND gate.

11. The array substrate according to claim 9, wherein the output circuits each comprise an AND gate.

12. The array substrate according to claim 9, wherein the shift registers, the pulse-overlap detecting circuits and the output circuits comprise thin film transistors.

13. An array substrate according to claim 12, wherein the thin film transistors are polycrystalline silicon thin film transistors.

14. An array substrate according to claim 9, wherein the signal line drive circuit is formed on the substrate, and said array substrate further comprises:

a group of analog switches which open/close depending on the logical product signals outputted consecutively from the output circuits; and video bus lines connected to the analog switches, for transferring video signals to the pixels.

15. An array substrate according to claim 9, wherein the signal line drive circuit comprises thin film transistors.

16. An array substrate according to claim 15, wherein the thin film transistors are p-ch silicon thin film transistors.

17. An array substrate according to claim 15, wherein thin film transistors which constitute the signal line drive circuit and the transistors are formed on the same substrate in the same laminate structure.

18. An array substrate according to claim 9, wherein the signal line drive circuit is driven in units of blocks of a predetermined group, which are defined by a group of analog switches.

19. A display device comprising:

pixels provided at intersections of scanning lines and signal lines arranged in matrix on a substrate, and connected to the signal lines via transistors;

timing control circuits for driving the pixels, wherein the timing control circuits each comprise:

a shift register portion made of shift registers connected in series, which consist of a plurality of flip-flop circuits which are connected in cascade, and serve to transfer a shift pulse to a next stage sequentially in synchronism with a predetermined clock signal, and output shift register output signals from each stage;

a NAND gate portion for inputting two shift register output signals to each of the shift registers, one for an input side and another for an output side, and outputting an output signal indicating an overlap section of these signals; and an AND gate portion for inputting the shift register output signals from the shift registers and the output signals from the NAND gate portion, and generating timing control signals which the shift register output signal outputted from the shift register of the previous stage turned off based on output signals from the NAND gate portion when shift register output signals are outputted from the shift register of a next stage while outputting the shift register output signals from the shift register of the previous stage, connected thereto in series, thus sequentially outputting the generating timing control signals.

20. An array substrate comprising:

scanning lines and signal lines arranged in matrix on a substrate;

transistors provided respectively at intersections of the scanning lines and the signal lines, and being in contact with the signal lines and the scanning lines;

a signal line drive circuit for applying video signals to the signal lines; and a timing control circuit formed in the signal line drive circuit, wherein the timing control circuits further comprises:

shift registers connected in series, and each serve to transfer a shift pulse to a next stage sequentially, and output shift register output signals from stages;

detecting circuits for detecting an overlapping portion of adjacent shift register output signals in synchronism with a leading edge of a shift register output signal of a next stage; and a plurality of output circuits, to which shift register output signals are input respectively, wherein said output circuits outputs control signals in which the overlapping portion with the shift register output signals of the next stage is removed from the shift register output signals.

21. An array substrate according to claim 20, wherein said plurality of output circuits, to which the shift register output signals of the next stage are input respectively, outputs signals in which the overlapping portion with the shift register output signals of the previous stage are removed from the shift register output signals of the next stage.

22. An array substrate according to claim 20, wherein the detecting circuits each comprise a NAND gate.

23. An array substrate according to claim 20, wherein the output circuits each comprise an AND gate.

24. An array substrate according to claim 20, wherein the shift registers, the detecting circuits and the output circuits comprise thin film transistors.

25. An array substrate according to claim 24, wherein the thin film transistors are polycrystalline silicon thin film transistors.

26. An array substrate according to claim 24, wherein the signal line and the timing control circuit are formed on the same substrate.

27. An array substrate according to claim 20, wherein the signal line drive circuit comprises thin film transistors.

28. An array substrate according to claim 27, wherein the thin film transistors are p-ch silicon thin film transistors.

29. An array substrate according to claim 27, wherein thin film transistors which constitute the signal line drive circuit and the transistors are formed on the same substrate.

30. An array substrate according to claim 20, wherein the signal line drive circuits are driven in units of blocks of a predetermined group.

31. A liquid crystal display device which employs an array substrate according to claim 20, further comprising:

liquid crystal pixels driven by the timing control circuits, and connected to the scanning lines and the signal lines via the transistors.

* * * * *